US005465438A

United States Patent [19]

Allman et al.

[11] Patent Number: 5,465,438

[45] Date of Patent: Nov. 14, 1995

[54] MOBILE NURSING STATION

[76] Inventors: Thomas Allman, 1423 20th Ave., SW., Puyallup, Wash. 98371; Cathy A. Lee, P.O. Box 2347, Santa Rosa, Calif. 95405

[21] Appl. No.: 342,554

[22] Filed: Jan. 9, 1995

[51] Int. Cl.[6] ..... A47K 1/02

[52] U.S. Cl. ..... 4/626; 4/628; 4/630; 4/640; 4/516

[58] Field of Search ..... 4/619, 625, 626, 4/628, 630, 631, 640, 516, 517, 518

[56] References Cited

U.S. PATENT DOCUMENTS

| | | | |
|---|---|---|---|
| 693,549 | 2/1902 | Kellogg | 4/626 X |
| 3,192,537 | 7/1965 | Coffman et al. | 4/516 |
| 3,579,656 | 5/1971 | Guarrasi | 4/626 X |
| 3,594,830 | 7/1971 | Clifton | 4/625 |
| 4,081,867 | 4/1978 | Simeola | 4/516 |
| 4,130,123 | 12/1978 | Wines, Jr. et al. | 4/626 X |
| 4,660,233 | 4/1987 | Beaver | 4/516 |
| 4,765,003 | 8/1988 | Chang | 4/626 X |
| 4,935,971 | 6/1990 | Dunn et al. | 4/516 X |
| 4,998,302 | 3/1991 | Silva | 4/516 |
| 5,182,822 | 2/1993 | Cyr et al. | 4/625 |

*Primary Examiner*—Robert M. Fetsuga
*Attorney, Agent, or Firm*—Robert K. Rhea

[57] ABSTRACT

A mobile nursing home unit is formed by an upright cabinet containing an assembly of nursing facilities including a sink and a superposed gray water tank and fresh water reservoir selectively supplying water to and draining from the sink into the gray water tank. Miscelleanous washcloths, soaps, lotions, towels and other desired small items are temporarily stored on the cabinet top wall and maintained thereon during mobile movement of the cabinet by a kitchen rail extending along adjacent edge limits of the top wall.

5 Claims, 3 Drawing Sheets

MOBILE NURSING STATION

BACKGROUND OF THE INVENTION

This invention relates to a self contained mobile nursing unit permitting various patient nursing functions to be performed in a convenient manner.

1. Field of the Invention

It is known to provide portable nursing kits for the care of patients.

However, these portable nursing kits are generally cosmetic in nature and do not offer a supply of water for cleaning and washing a patient. Even in hospital facilities where a patient occupies a room provided with toilet facilities, including a sink, water must be carried to and from the patient when the patient is incapacitated and must remain in bed.

This invention provides a mobile unit disposed at the bedside which provides most of the equipment and facilities for washing and cleaning a bedridden patient in both private and public nursing homes or hospitals.

2. Description of the Prior Art

The most pertinent patent is believed to be U.S. Pat. No. 4,130,123 issued Dec. 19, 1978 to Wines Jr. et al for PORTABLE NURSING DEVICE. This patent discloses a mobile cabinet containing basins or receptacles receiving hot and cold water from an onboard source through flexible conduits. The cabinet also has a separate compartment containing a water heater connected with a waste drain pump for the disposal of patient body waste.

U.S. Pat. No. 3,594,830 issued Jul. 27, 1971 to Clifton for PORTABLE SINKS and U.S. Pat. No. 5,182,822 issued Feb. 2, 1993 to Cyr, et al, for CHILD SINK APPARATUS are believed to be good examples of the further state-of-the-art.

U.S. Pat. No. 3,594,830 discloses a camper's frame supported sink and basin provided with an electrical pump for moving water to the sink.

U.S. Pat. No. 5,182,822 discloses a housing supporting a sink having a hand operated pump moving water to the sink which drains into a second container.

The present invention is believed distinctive over these patents by its hereinafter described several cooperating components forming a combination believed essential for a complete mobile nursing facility for bedridden patients.

SUMMARY OF THE INVENTION

A rectangular upright mobile frame has its top, bottom, sides and ends closed by wall panels with a sink recessed in the top wall panel.

A pump connected with a source of electrical energy and a fresh water tank within the frame supplies warm water to the sink through a faucet valve. A superposed gray water tank receives liquid draining from the sink. Rigid and flexible valve equipped tubing is connected with the gray water tank for periodic draining.

The principal object of this invention is to provide a self contained mobile nursing unit which includes an assembly of necessary nursing care components including a quantity of fresh water, at a selected temperature, at the bedside of patients.

DESCRIPTION OF THE PREFERRED EMBODIMENTS

Figure 1:
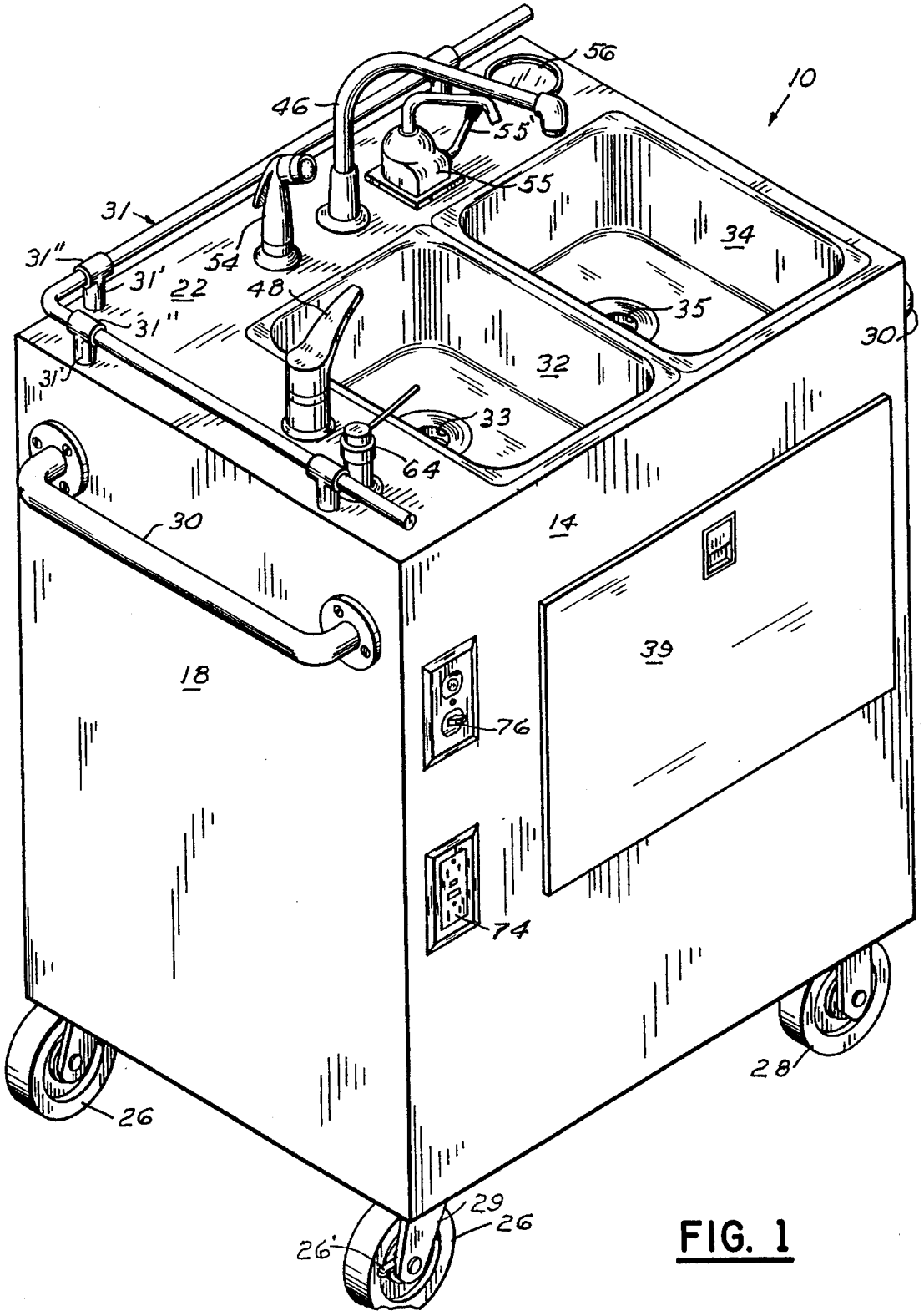
FIG. 1 is a perspective view of the unit.

Like characters of reference designate like parts in those figures of the drawings in which they occur.

In the drawings:

The reference numeral 10 indicates a portable nursing unit, as a whole, which is an upright rectangular cabinet-like in general configuration.

The cabinet 10 comprises an open frame 12 formed from angular or tubular material overlaid with sheet material to form a front wall 14, a back or rearward wall 16, opposing end walls 18 and 20 orthogonally disposed with respect to a top wall 22 and a bottom wall 24.

The top wall 22 having a pair of Juxtaposed recessed sink cavities 32 and 34 adjacent the front wall 14 and one end wall 20, each sink cavity having a sink cavity floor and a drain outlet, 33 and 35, respectively. A faucet 46 is rotatably mounted to the top wall 22 between the sink cavities and the back wall 16. The faucet extends over the sink cavities and is horizontally movable at one end portion from one sink cavity to the other one of the pair of sink cavities. The faucet includes a handicapped person's single handle faucet valve 48 to selectively direct fluid flow through the faucet.

A rod-like L-shaped kitchen rail 31 is mounted on the top wall 22 adjacent the back wall 16 and the end wall 18 in substantial coextensive relationship with the top wall between the cabinet end walls 18 and 20 and between the cabinet front wall 14 and back wall 16.

The rail defines a portion of a fence-like boundary of a temporary storage area between the kitchen rail and the pair of sink cavities for small items of hygiene, such as soaps, shampoos, and washcloths for maintaining such items on the top wall during mobile movement of the cabinet. The kitchen rail comprises a plurality of upright T-shaped kitchen rail mounts, formed by a stem portion 31' secured to the top wall 22 and a tubular bar portion 31" cooperatively axially surrounding intermediate portions of the L-shaped kitchen rail rod.

A pair of castor wheels 26 each having a manually operated brake 26' and a pair of rigid castor-like wheels 28 are connected in depending relation with the bottom wall 24 adjacent its ends and support the cabinet 10 for movement in a mobile manner.

Each caster wheel of the pair of caster wheels 26 include a bearing bracket 27 secured to the cabinet bottom wall for angular rotation of the bracket wheel journalling legs 29 and the caster wheel about a vertical axis.

Hand rails 30, such as safety grab bars are connected with the upper end portion of the respective end walls to form handles for manually moving the cabinet.

The cabinet 10 is horizontally divided by a partition 46 forming an upper compartment 47 and a lower compartment 49. A fresh water reservoir 36 having a top wall 52 is supported within the cabinet bottom compartment 49 by the bottom wall 24. The top wall 52 of the fresh water reservoir tank has an inlet opening 50 and an outlet opening 51. The reservoir 36 is filled by a fresh-water tube 38 connected at one end with the inlet opening 50 and having its other end projecting through the cabinet end wall 20 to form an inlet opening, as at 38'. A fresh water supply tube 44 extending substantially the full depth of the fresh water reservoir 36 through an outlet 45 connects the fresh water reservoir with the faucet 46 through the control valve 48. Other fresh water tubing 40 connected with the fresh water reservoir opening 51 is connected at its other end, as at 40', through the wall 20 for admitting and exhausting air to and from the reservoir 36. A fresh water reservoir fill tube extension 38" is normally stored within the cabinet 10 and accessed through a cabinet door 39 in the front wall 14 for filling the fresh water reservoir from a fresh water tap, not shown. The reservoir 36 is provided with a conventional sight glass 42 for indicating the water level within the reservoir.

Figure 2:
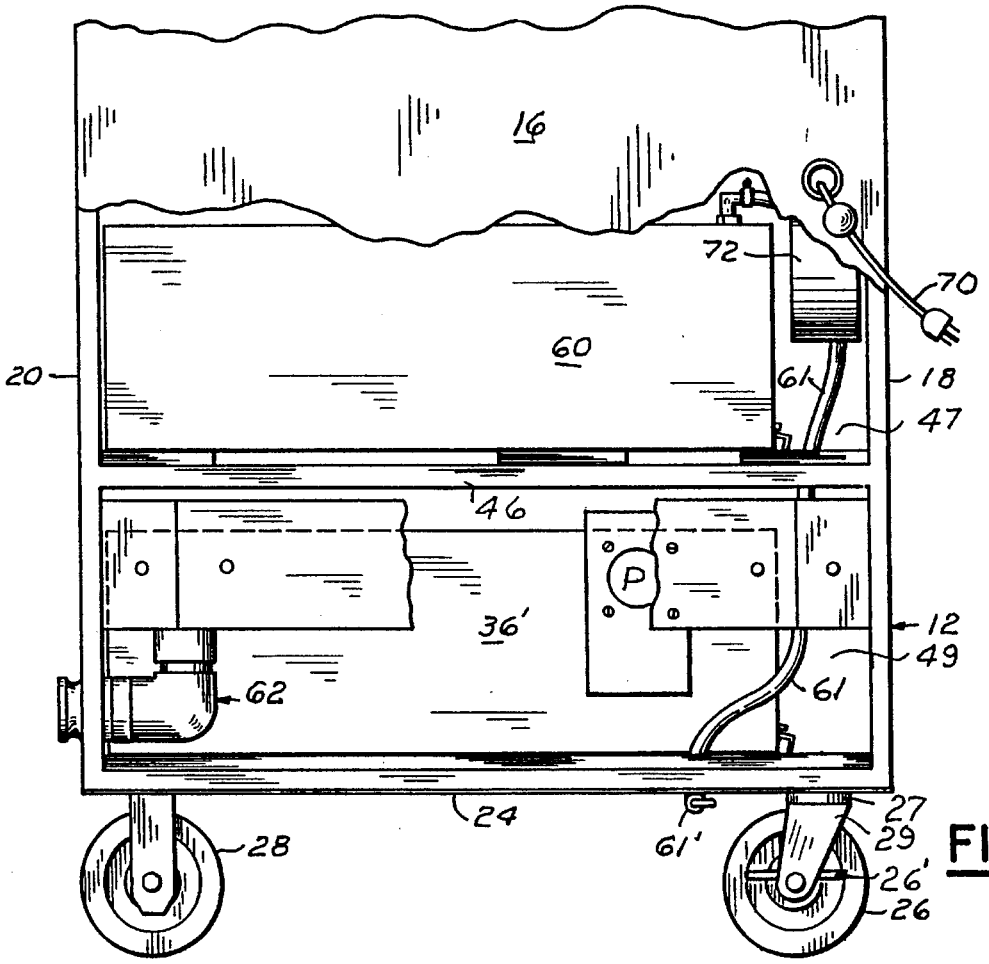
FIG. 2 is a fragmentary rearward elevational view with parts broken away for clarity.
Figure 3:
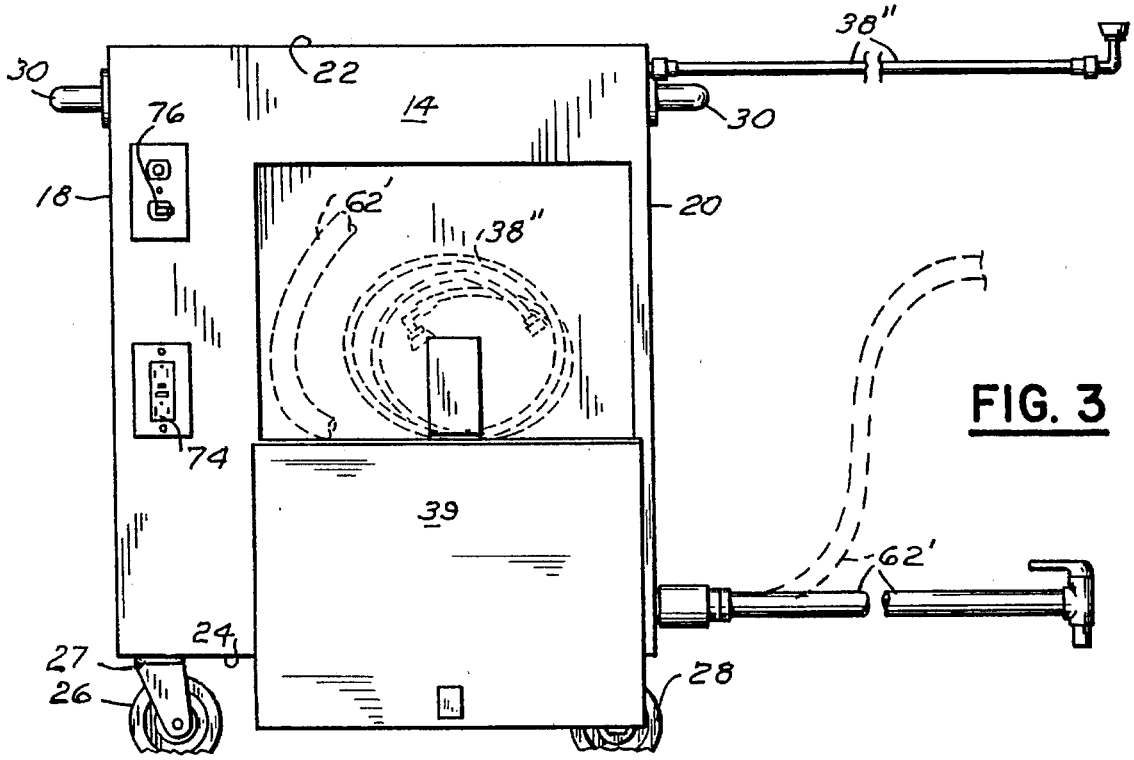
FIG. 3 is a front elevational view with the top wall upstanding components removed; and, FIG. 4 is an end elevational view, opposite that shown by FIG. 1, with the top wall coponents, the cabinet handle and the reservoir heating pad removed with portions broken away for clarity.
Figure 4:
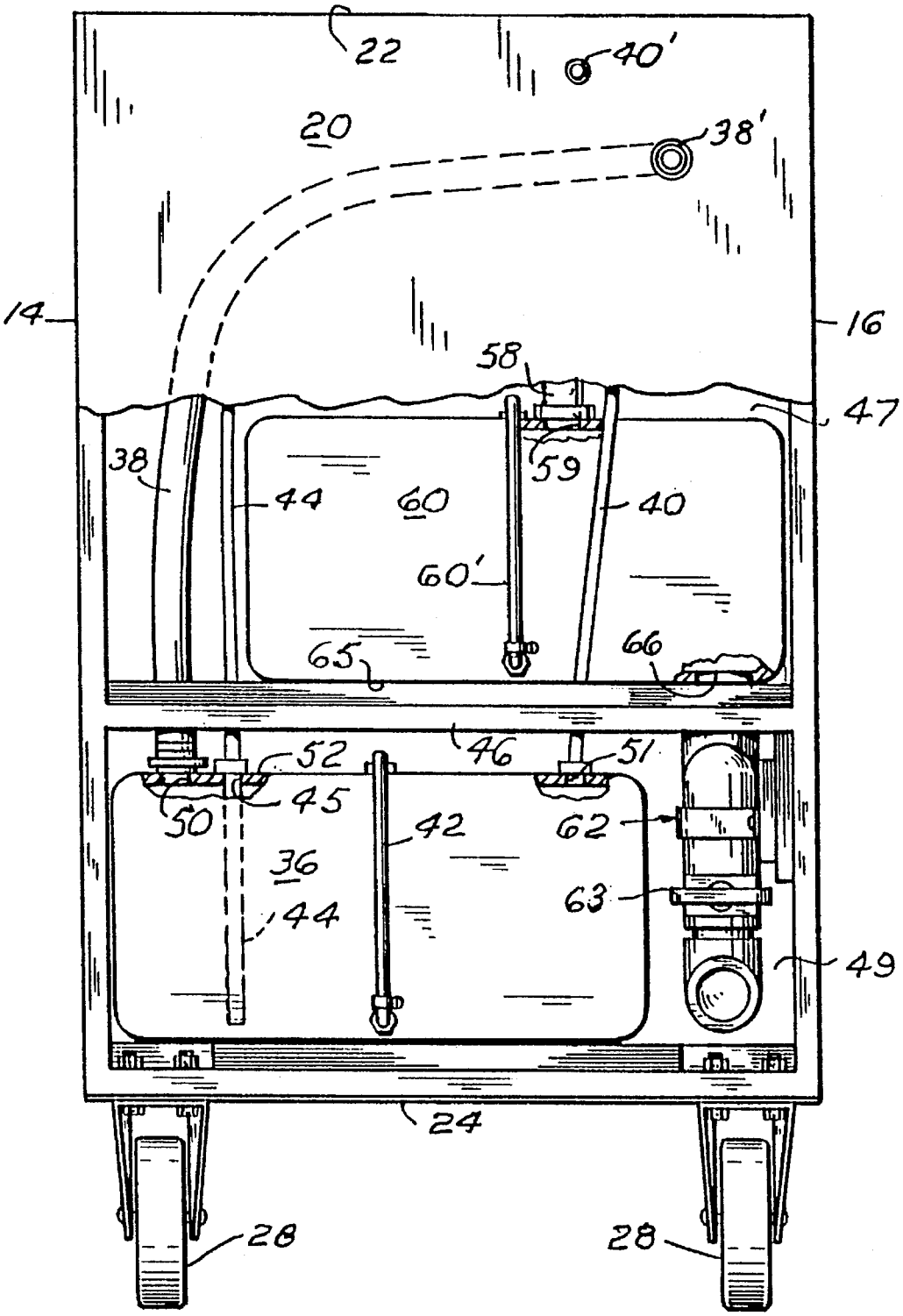

The reservoir 36 is preferably surrounded by a thermostat controlled thermal unit such as a heating pad 36' (FIG. 2) connected with a source of electrical energy, not shown, for heating water contained by the reservoir. Heat generated by the thermal unit 36' in maintaining a desired fresh water temperature also maintains the temperature within the cabinet 10 above ambient temperature which is utilized for warming washcloths and hand towels stored within the cabinet.

An electric motor driven pump P connected with the reservoir 36 and a source of electrical energy is energized and deenergized by a pressure responsive switch, neither being shown, for supplying air under greater than atmospheric to the reservoir and maintaining the fresh water in the reservoir 36 under sufficient pressure to force it through the faucet 46.

A hand pump 55 supported by the top wall 22 and operated by a handle 55' is connected in a conventional manner with the reservoir 36 for use in event of electrical failure.

A valve controlled spray tube 54 projecting through the top wall 22 is similarly supplied with water, in a conventional manner, from the reservoir 36. A temperature gauge 56 mounted on the top wall 22 indicates the water temperature in the reservoir 36.

Water drains from the sink cavities 32 and 34 through a P trap, not shown, having its outlet 58 connected with the top wall inlet port 59 of a gray water tank 60 having a bottom wall 65, supported by the partition 46 within the top compartment 47 and similarly having a fluid level indicating sight glass 60'. An air vent tube 61 communicating with the gray water tank 60 through its top wall extends downwardly through the cabinet bottom wall 24 and terminates in a normally open petcock 61'. Gray water drain piping 62, including a slide valve 63, is connected with the gray water tank bottom wall outlet port 66 for emptying the gray water tank through a flexible extension tube 62' normally similarly stored in the cabinet with the fill tube 38".

A liquid soap or lotion dispenser 64 is also mounted on the cabinet top wall 22.

An electrical extension cord 70, spring wound on a reel contained by a housing 72 within the cabinet, connects a source of electrical energy, not shown, with the pump P, thermal unit 36' and an electrical outlet 74 through an "on-off" control switch 76.

OPERATION

Operation of the unit is believed obvious, but briefly stated: the unit is initially prepared by filling the fresh water reservoir 36 by utilizing the fill tubes 38 and 38"; connecting the electrical cord 70 with a source of electrical energy; turning on the heating unit thermostat if not "on"; ensuring that the gray water tank valve 63 is in closed position; and, that the gray water tank air vent tube valve 61' is in open position.

Thereafter the unit is manually moved from patient to patient and after performing nursing services or when the gray water tank 60 becomes full or nearly full, the cabinet 10 is moved to a place of water disposal such as a water closet or other drain. The flexible hose 62' is removed from the cabinet and attached to the rigid drain tubing 62 connected with the tank 60 and the valve 63 opened.

Obviously the invention is susceptible to changes or alterations without defeating its practicability. Therefore, we do not wish to be confined to the preferred embodiment shown in the drawings and described herein.

We claim:

1. A mobile nursing station, comprising:

an assembly of components, the components including:

an upright rectangular cabinet having vertically spaced top and bottom walls and front and back and end walls extending vertically therebetween in orthogonal relationship, the top wall including a pair of juxtaposed recessed sink cavities adjacent the front wall and one end wall, each sink cavity of said pair of sink cavities having a sink cavity floor, and each sink cavity floor of said pair of sink cavity floors having a drain outlet, and a faucet rotatably mounted to the top wall in adjacency to the sink cavities extending over and movable from one sink cavity of the pair of sink cavities to the other one of the pair of sink cavities, and the faucet including a faucet valve to selectively direct fluid flow through the faucet, and a rod-like L-shaped kitchen rail mounted to the top wall in adjacency to the back wall and the end wall opposite said one end wall in substantial coextensive relationship with the top wall between the cabinet end walls and between the cabinet front wall and back wall, for forming a temporary storage area between the kitchen rail and the pair of sink cavities, and the kitchen rail having a plurality of spaced-apart upright T-shaped kitchen rail mounts, each kitchen rail mount of said plurality of kitchen rail mounts having a stem portion secured to the top wall and having a tubular bar portion cooperatively axially surrounding an intermediate portion of the L-shaped kitchen rail rod, and a plurality of caster wheels depending from said bottom wall in cabinet supporting relationship, each caster wheel of said plurality of caster wheels including a bracket secured to the cabinet bottom wall adjacent an end wall of the cabinet, the bracket having bracket legs journalling the caster wheel, and a wheel brake for immobilizing a caster wheel secured to at least one caster wheel bracket of said plurality of caster wheels, and the cabinet having a horizontal dividing partition forming an upper compartment an a lower compartment, and a gray water tank having vertically spaced tank top and tank bottom walls within the upper compartment, the gray water tank top wall having a gray water inlet opening, and sink cavity drain tubing connecting the sink cavity floor drain outlets with the gray water tank inlet opening, the gray water tank bottom wall having a gray water outlet opening, and a gray water tank valve normally closing the gray water tank drain opening, and a fresh water reservoir having a top wall within the bottom compartment, the fresh water reservoir top wall having an inlet opening and an outlet opening, and fresh water tubing extending between and connecting the faucet with the fresh water outlet opening, and an electric motor driven pump interposed in the fresh water tubing, and a source of electrical energy connected with the pump motor.

2. The nursing station according to claim 1 in which the assembly of components further includes:

heater means including a heating pad transversly surrounding the fresh water reservoir for heating the fresh water therein; and, wherein the pump maintains fresh water in the fresh water tank under a greater than atmosphere pressure.

3. The nursing station according to claim 2 in which the assembly of components further includes:

control means for connecting a source of electrical energy with the pump and heater means.

4. The nursing station according to claim 3 in which the assembly of components further includes:

a sight glass mounted on said fresh water reservoir and said grey water tank.

5. The nursing station according to claim 4 in which the assembly of components further includes:

a spray tube extending from the fresh water reservoir through the top wall adjacent the sink cavities and having a spray valve on its end opposite the fresh water reservoir; and, a liquid soap dispenser supported by the top wall adjacent the sink cavities.

* * * * *